US005996364A

United States Patent [19]

Lifson et al.

[11] Patent Number: 5,996,364

[45] Date of Patent: Dec. 7, 1999

[54] SCROLL COMPRESSOR WITH UNLOADER VALVE BETWEEN ECONOMIZER AND SUCTION

[75] Inventors: Alexander Lifson, Manlius; James W. Bush, Skaneateles, both of N.Y.

[73] Assignee: Carrier Corporation, Farmington, Conn.

[21] Appl. No.: 09/114,395

[22] Filed: Jul. 13, 1998

[51] Int. Cl.[6] ..... F25B 41/00; F25B 49/00

[52] U.S. Cl. ..... 62/196.1; 62/228.5

[58] Field of Search ..... 62/196.1, 196.3, 62/197, 215, 228.1, 228.5, 505, 498, 510

[56] References Cited

U.S. PATENT DOCUMENTS

| | | | |
|---|---|---|---|
| 3,564,865 | 2/1971 | Spencer et al. | 62/197 |
| 4,332,144 | 6/1982 | Shaw | 62/324.1 |
| 4,787,211 | 11/1988 | Shaw | 62/117 |
| 5,076,067 | 12/1991 | Prenger et al. | 62/197 |
| 5,410,889 | 5/1995 | Sjoholm et al. | 62/160 |
| 5,722,257 | 3/1998 | Ishii et al. | 62/505 |
| 5,816,055 | 10/1998 | Ohman | 62/117 |

*Primary Examiner*—William Doerrler
*Attorney, Agent, or Firm*—Howard & Howard

[57] ABSTRACT

A scroll compressor has an economizer injection line communicating into the scroll compressor chambers. An unloader valve selectively communicates the economizer injection line back to suction. In this arrangement, the fluid ports and passages necessary to achieve the economizer injection are also utilized to achieve suction bypass unloading, and thus the compressor and system design and construction are simplified.

17 Claims, 2 Drawing Sheets

SCROLL COMPRESSOR WITH UNLOADER VALVE BETWEEN ECONOMIZER AND SUCTION

BACKGROUND OF THE INVENTION

This invention relates to a unique placement for an unloader valve, that is particularly beneficial in a scroll compressor.

Scroll compressors are becoming widely utilized in compression applications. However, scroll compressors present several design challenges. One particular design challenge is achieving reduced capacity levels when full capacity operation of the compressor is not desired. In many situations, it may not be desirable to have full capacity of the compressor. In particular, in many refrigeration or refrigerant compression applications, there are times when it would be more desirable to have the ability to achieve reduced capacity.

Thus, scroll compressors have been provided with unloader bypass valves which divert a portion of the compressed refrigerant back to a suction port for the compressor. In this way, the mass of refrigerant being compressed is reduced.

On the other hand, in many refrigeration or refrigerant compression applications, there are other times when it would be more desirable to have the ability to also achieve increased capacity. One way of achieving increased capacity is the inclusion of an economizer circuit into the refrigerant system. An economizer circuit essentially provides heat transfer between a main refrigerant flow downstream of the condenser, and a second refrigerant flow which is also tapped downstream of the condenser and passed through an expansion valve. The main flow is cooled in a heat exchanger by the second flow. In this way, the main flow from the condenser is cooled before passing through its own expansion valve and entering the evaporator. Since the main flow enters the expansion valve at a cooler temperature, it has greater capacity to absorb heat which results in increased system cooling capacity, which was the original objective. The refrigerant in the second flow enters the compression chambers at a point slightly downstream of suction at an intermediate compression point. Typically, the economizer fluid is injected at a point after the compression chambers have been closed.

It would be desirable to combine the features of selectively reduced capacity and increased capacity within the same compressor and system. Conventional practices would dictate independent sets of ports, passages, valves, and controls for the dual capability. Such proliferation of features also dictates increased complexity and cost to manufacture.

SUMMARY OF THE INVENTION

In a disclosed embodiment of this invention, a scroll compressor is provided with an economizer circuit, and also a suction line. A bypass line is positioned to communicate between the economizer circuit and the suction line and an unloader valve is positioned on the bypass line and is operable to selectively communicate the economizer injection line to the suction line. A valve on the economizer injection line may be closed and the unloader valve opened; then the economizer injection ports in the compressor serve as bypass ports and tap fluid back to suction.

In this way, the same fluid flow passages and ports which are utilized to provide the economizer injection function are also utilized for the unloader function. Thus the assembly and operation of the scroll compressor is greatly simplified which results in improved cost and reliability.

There may be a single port or a plurality of ports arranged along an arc in each compression pocket which operate alternately as both economizer injection and bypass ports.

These and other features of the present invention can be best understood from the following specification and drawings, the following of which is a brief description.

DETAILED DESCRIPTION OF THE PREFERRED EMBODIMENT

Figure 1:
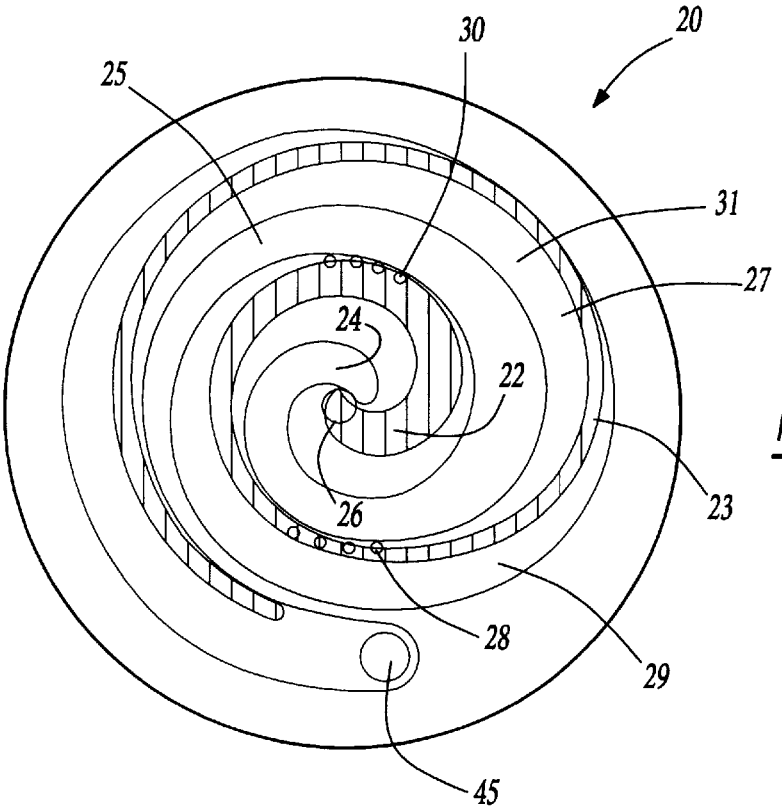
FIG. 1 shows a scroll compressor in one operational state.

A scroll compressor 20 is illustrated in FIG. 1 having an orbiting scroll element 22 which includes an orbiting scroll warp 33 and a fixed, or non-orbiting, scroll element 24 which includes a non-orbiting scroll wrap 25. The scroll wraps interfit and surround discharge port 26. As known, the orbiting scroll element 22 orbits relative to the non-orbiting scroll element 24 and the scroll wraps 23 and 25 selectively trap pockets of refrigerant which are compressed toward discharge port 26. A plurality of ports 28 and 30 are formed in the base 31 of the non-orbiting scroll element 24. Alternately, ports 28 and 30 may consist of a pair of single, larger ports. In the position shown in FIG. 1, ports 28 and 30 are just being uncovered by the orbiting scroll wrap 23 at about the same time as compression chambers 27 and 29 are being sealed from a zone that communicates with suction line 45.

Figure 2:
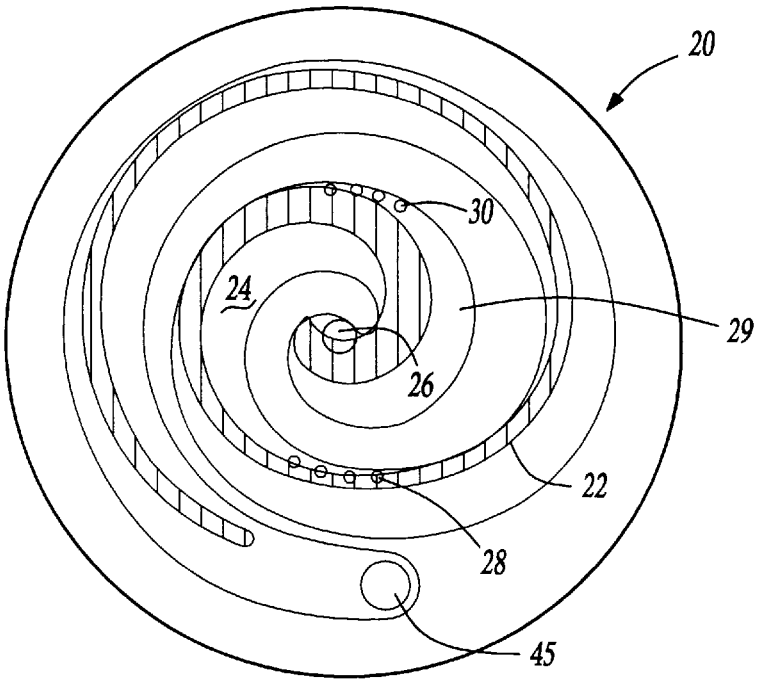
FIG. 2 shows the scroll compressor at a slightly different operational state.

As shown in FIG. 2, with continued movement of the orbiting scroll wrap, ports 28 and 30 are uncovered and are exposed to compression chambers 27 and 29 which have been closed by the movement of the orbiting scroll wrap 23 to contact the non-orbiting scroll wrap 25.

Figure 3:
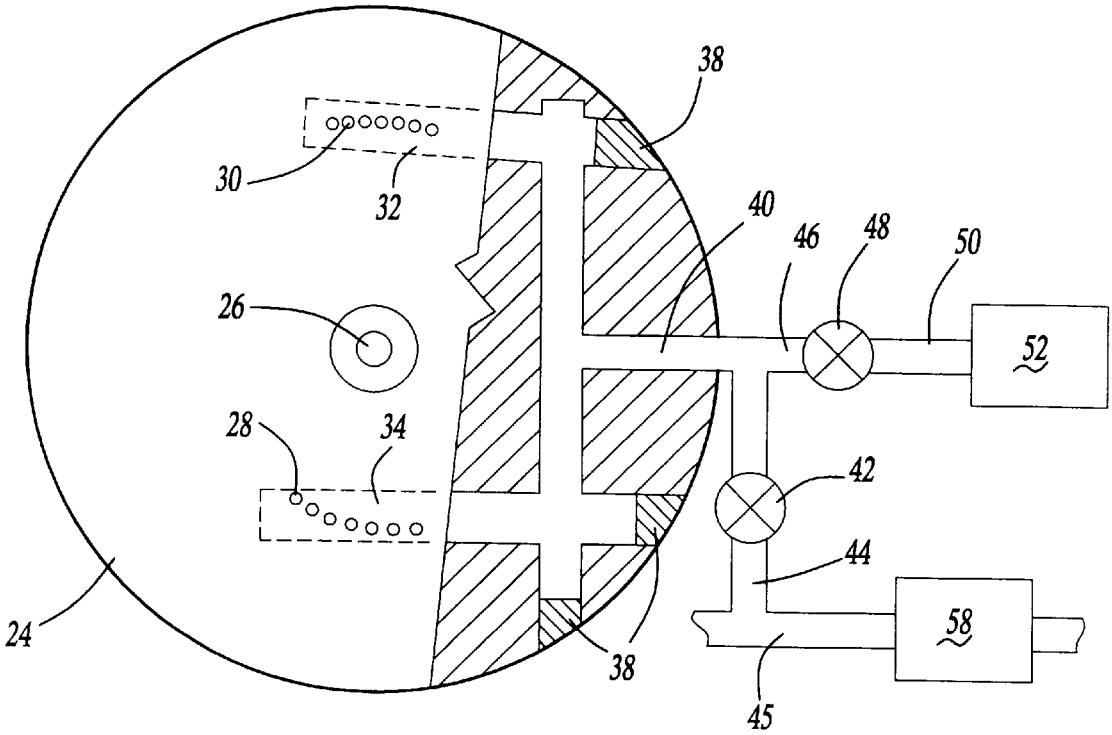
FIG. 3 is an end view of the non-orbiting scroll of the present invention.
Figure 4:
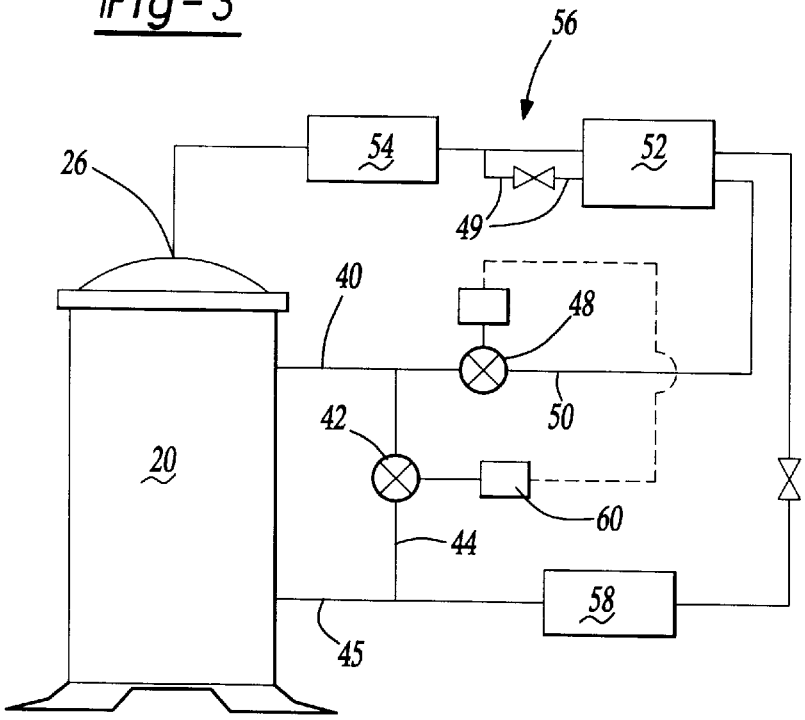
FIG. 4 is a schematic view of a refrigeration system.

As shown in FIG. 3, a first passage 32 communicates with ports 30 and a second passage 34 communicates with ports 28. A crossing passage 36 communicates between passages 32 and 34. A series of plugs 38 close the passages 32, 34, and 36 as appropriate. A passage 40 communicates crossing passage 36 to a bypass valve 42 which leads to a line 44 leading back to a suction line 45 and to a passage 46 which leads to an economizer valve 48 which communicates with an economizer injection line 50 which is communicated to an economizer heat exchanger 52 or economizer flash tank. As shown in FIG. 4, the economizer heat exchanger 52 is positioned just downstream of the condenser 54 of a refrigerant system 56 which incorporates the scroll compressor 20. Alternatively, economizer valve 48 may be positioned in line 49 just upstream of the economizer heat exchanger 52.

Either the unloader valve 48 and/or bypass valve 42 may be positioned in the compressor housing, or outside the compressor housing.

During operation of the scroll compressor, three levels of capacity may be achieved with the inventive system. First, under full capacity the economizer valve 48 is opened, the bypass valve 42 is closed, and economized operation occurs. Fluid passes from line 50 into passage 40, passage 36, passages 32 and 34, and through ports 28 and 30 into the compression chambers 27 and 29. As known generally in the refrigeration art, this increases the capacity of the refrigerant system by improving the thermodynamic state of the fluid approaching the evaporator 58.

When a lower capacity is desired, then both valves 48 and 42 may be closed. In such operation, the compressor operates without economized operation and without bypass. A control 60 operates the system 56, including valves 48 and 42.

Finally, when an even lower of capacity level is desired the economizer valve 48 is closed and bypass valve 42 is opened. Now, fluid which has been trapped within the compression chambers passes through ports 28 and 30, outwardly through passages 32 and 34, 36, 40, 44 and into suction line 45. The fluid is thus bypassed back to the inlet of scroll compressor 20.

Preferably, the bypass path 44 and valve 42 are positioned outwardly of the scroll compressor housing, thus simplifying the assembly of the scroll compressor housing. However, the bypass path 44 and valve 42 may be within the housing.

In general, the present invention achieves benefits by utilizing a single set of ports and passages to achieve both economized and bypass operation. In this way, the present invention improves upon the prior art. Further, since the bypass occurs at a point only slightly into the compression cycle, there is little wasted energy from compressing fluid that is then bypassed.

The unloader valve of this application is particularly well suited for performing the method described in co-pending patent application no._____, filed on even date herewith, and entitled "Control of Scroll Compressor at Shutdown to Prevent Unpowered Reverse Operation". This unloader valve has particular beneficial characteristics when utilized in a refrigeration system for a refrigerated transport unit such as are used in intermodal transport containers where the system must be operated over a wide range of capacities and conditions. Such transport containers are utilized to transport refrigerated goods on truck, rail and ship.

Another application of interest is U.S. Ser. No. 08/986,447 filed May 12, 1997 and entitled "PULSED FLOW FOR CAPACITY CONTROL".

A preferred embodiment of this invention has been disclosed, however, a worker of ordinary skill in the art would recognize that certain modifications come within the scope of this invention. For that reason the following claims should be studied to determine the true scope and content of this invention.

What is claimed is:

1. A compressor comprising:

(a) a compressor pump unit;

(b) a suction inlet and suction passage communicated to a supply of refrigerant to be compressed by said compressor pump unit;

(c) at least one economizer injection port communicating with said pump unit at a location downstream of said suction inlet; and (d) an unloader valve for selectively communicating a compressed refrigerant from said pump unit through said economizer injection port to said suction passage.

2. A compressor as recited in claim 1, wherein said pump unit is a scroll compressor pump unit.

3. A compressor as recited in claim 1, wherein said unloader valve is positioned in a bypass passage mounted outwardly of a compressor housing.

4. A compressor as recited in claim 1, wherein said unloader valve is positioned in a bypass passage mounted inwardly of a compressor housing.

5. A compressor unit as recited in claim 1, wherein there are a plurality of economizer injection ports leading into said compressor pump unit.

6. A scroll compressor comprising:

(a) an orbiting scroll having a base and a scroll wrap extending from said base;

(b) a non-orbiting scroll having a base and a scroll wrap extending from said base and interfitting with said orbiting scroll wrap to define compression chambers;

(c) an economizer injection port passing into said compression chambers, said economizer injection port communicating with an economizer injection passage, which is connected to an economizer circuit;

(d) a suction passage passing a suction fluid into said scroll compressor unit; and (e) an unloader system selectively communicating said economizer injection passage to said suction passage, said unloader system including a bypass line communicating said economizer injection passage to said suction passage and an unloader valve selectively opening in said bypass line, compressed refrigerant from said compression chambers passing through said economizer injection passage and to said suction passage when said unloader valve is open.

7. A scroll compressor as recited in claim 6, wherein a control selectively opens said unloader valve.

8. A scroll compressor as recited in claim 6, wherein there are two of said injection ports extending into said compression chambers and said two ports are spaced by a circumferential distance.

9. A scroll compressor as recited in claim 8, wherein each of said ports consists of a plurality of ports.

10. A scroll compressor as recited in claim 6, wherein an economizer valve is placed on said economizer injection passage.

11. A scroll compressor as recited in claim 10, wherein said economizer valve is shut when said unloader valve is open.

12. A compressor as recited in claim 6, wherein said economizer valve is positioned in a bypass passage mounted outwardly of a compressor housing.

13. A compressor as recited in claim 6, wherein said economizer valve is positioned in a bypass passage mounted inwardly of a compressor housing.

14. A compressor as recited in claim 6, wherein said unloader valve is positioned in a bypass passage mounted outwardly of a compressor housing.

15. A compressor as recited in claim 6, wherein said unloader valve is positioned in a bypass passage mounted inwardly of a compressor housing.

16. A compressor as recited in claim 1, wherein an economizer system supplies refrigerant to said economizer injection port, and an economizer valve disposed between said economizer injection port and said economizer system and upstream of a point where said unloader valve communicates with said economizer injection port, said economizer valve being shut when said unloader valve is opened.

17. A scroll compressor as recited in claim 11, wherein said economizer valve is placed upstream of a location where said unloader valve communicates with said economizer injection passage.

* * * * *

UNITED STATES PATENT AND TRADEMARK OFFICE

CERTIFICATE OF CORRECTION

PATENT NO : 5,996,364

DATED : Dec. 7, 1999

INVENTOR(S) : Lifson et al.

It is certified that error appears in the above-identified patent and that said Letters Patent is hereby corrected as shown below:

In Column 3, Line 30 of the patent, please replace "_____" with --09/114,461--.

Signed and Sealed this

Twelfth Day of December, 2000

*Attest:*

*Attesting Officer*

Q. TODD DICKINSON

*Director of Patents and Trademarks*